US006148702A

United States Patent [19]

Bucks

[11] Patent Number: 6,148,702

[45] Date of Patent: Nov. 21, 2000

[54] METHOD AND APPARATUS FOR UNIFORMLY SLICING FOOD PRODUCTS

[75] Inventor: Brent L. Bucks, Valparaiso, Ind.

[73] Assignee: Urschel Laboratories Incorporated, Valparasio, Ind.

[21] Appl. No.: 09/293,832

[22] Filed: Apr. 19, 1999

Related U.S. Application Data

[60] Provisional application No. 60/082,278, Apr. 20, 1998.

[51] Int. Cl.[7] ..... B26D 1/36

[52] U.S. Cl. ..... 83/13; 83/110; 83/356.3; 83/663; 83/675

[58] Field of Search ..... 83/13, 663, 675, 83/356.3, 110; 241/89.4

[56] References Cited

U.S. PATENT DOCUMENTS

| | | | |
|---|---|---|---|
| 410,582 | 9/1889 | Enoch | 83/356.3 |
| 553,385 | 1/1896 | Beamer | 83/356.3 |
| 2,482,523 | 9/1949 | Urschel et al. | 146/110 |
| 2,665,723 | 1/1954 | Urschel et al. | 146/124 |
| 3,004,572 | 10/1961 | Urschel et al. | 146/109 |
| 3,139,128 | 6/1964 | Urschel et al. | 146/78 |
| 3,139,129 | 6/1964 | Urschel et al. | 146/241 |
| 4,181,053 | 1/1980 | Duddridge | 83/110 |
| 4,271,740 | 6/1981 | Yamazaki et al. | 83/356.3 |
| 4,813,317 | 3/1989 | Urschel et al. | 83/356.3 |

*Primary Examiner*—M. Rachuba
*Assistant Examiner*—Sean Pryor
*Attorney, Agent, or Firm*—Bacon & Thomas PLLC

[57] ABSTRACT

A method of cutting food products into uniform thickness slices using a rotary cutting wheel fitted with radially extending, circumferentially spaced, tensioned and forwardly pitched bevel sharpened cutter blades rotating in a cutter plane and extending between a central hub and an annular rim and wherein the blades produce a first velocity of advancement of unsliced food product across the cutting plane for each revolution of the cutting wheel and a given slice thickness during slicing of food product advanced through the cutting plane. The method includes fitting an appropriate number of blades to the rotary cutting wheel to produce the given slice thickness of food products at the operation rotational velocity of the cutting wheel and rotating the cutting wheel at an operational rotational velocity to produce the first velocity of advancement of unsliced food products through the cutting plane of the cutting wheel. The food products are fed to the cutting plane of the blades of the cutting wheel at a second velocity such that the second velocity corresponds closely to about 101.5% of the first velocity as a result of a selection of configuration and tension of the blades so that they have maximum stiffness and resistance to both longitudinal and transverse flexure during cutting of food products. A cutter blade is disclosed wherein the leading edge portion of the blade member is longer than the maximum distance between fastener apertures at each end area of the blades and wherein the straight trailing edge portion of the blade member is shorter than the minimum distance between aperture diameters.

7 Claims, 4 Drawing Sheets

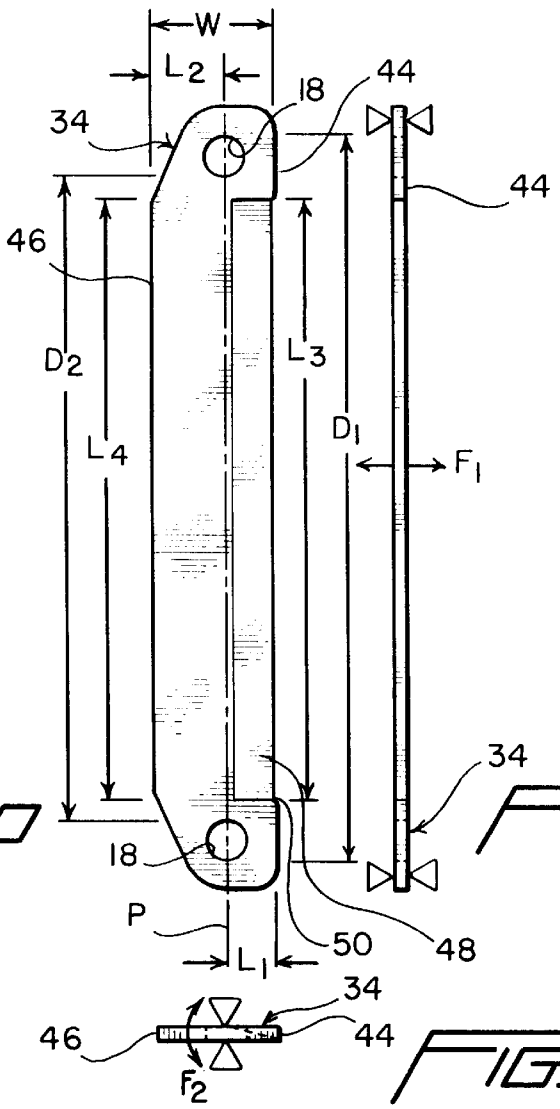
FIG. 11
FIG. 12
FIG. 10
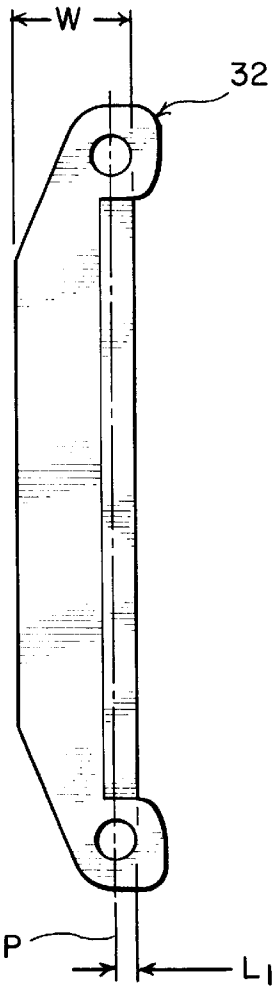
FIG. 9
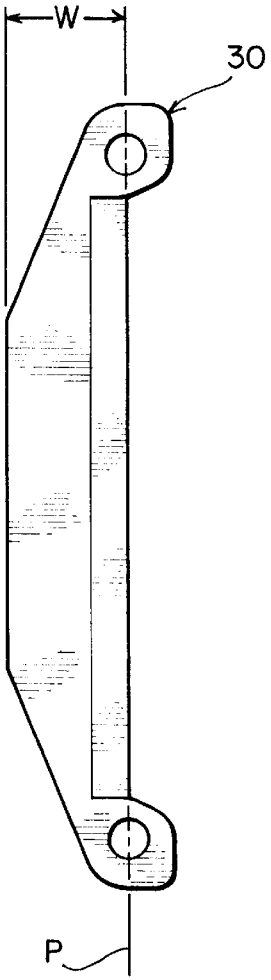
FIG. 8

METHOD AND APPARATUS FOR UNIFORMLY SLICING FOOD PRODUCTS

This application claims benefit of Provisional Application Serial No. 60/082,278 filed Apr. 20, 1998.

FIELD OF THE INVENTION

The invention is in the field of high speed food slicing machines used to reduce larger size of food products into uniform slices for processing and consumption.

BACKGROUND OF TECHNOLOGY

A known type of high speed food slicing machine uses a rotary cutting wheel carrying radially extending circumferentially spaced, tensioned and pitched thin metal blades for slicing food products such as vegetables, meat products, fruits, etc. that are advanced into the cutting plane of the rotating blades by a conveyor or gravity into slices that can be further processed or directly consumed by a consumer.

Exemplary slicing machines of this type are depicted in U.S. Pat. Nos. 2,482,523 granted Sep. 20, 1949; 3,004,572 granted Oct. 17, 1961; and 2,665,723 granted Jan. 12, 1954, all of which are owned in common with the owner of the invention described herein. U.S. Pat. Nos. 2,482,523 and 3,004,572 show rotary slicers wherein the unsliced food product is advanced to one portion of a generally vertically extending cutting plane of the rotary blades by a generally horizontal conveyor belt system that may include single or multiple belt arrangements that feeds the food products towards an area of the cutting plane where the blades are moving generally downwardly relative to the food product so that the cutting action is across the leading side of the food product and downwardly relative to the food product and the conveyor so that the food product is stabilized by the conveyor during the slicing process. In the machine depicted in U.S. Pat. No. 2,665,723, the food product to be sliced is fed gravitationally vertically towards a horizontal cutting plane defined by rotary cutter blades that are somewhat shorter than the cutter blades in the preceding examples and which are mounted on the cutting wheel which lies generally in a horizontal plane.

In machines of this type, relatively thin stainless steel hardened metal blades having a single sharpened leading edge that may be straight or scalloped are mounted so as to extend radially between a hub and a rim of a cutting wheel much like spokes of a bicycle wheel. Also, in the manner of wheel spokes, the blades are placed in uniform tension by clamping the blades at their ends by tension pin fasteners respectively to the hub and rim of the cutting wheel and then pulling the inboard ends of the blades through the inboard fasteners collectively and uniformly towards the center line of the axis of rotation of the cutting wheel. The blades of such machines, moreover, are forwardly pitched or slanted much like a propulsion propeller or impeller, with the pitch varying between the radially inner and outer ends of the blades to compensate for the difference in blade relative linear speed at the radially inner and outer ends of the blades. The rotating pitched blades throw or impel the cut slices in a forward direction extending transversely of the cutting planes of the blades in the same general direction of advancement of the food product towards the blades and also cause advancement or impelling of the unsliced food product into and through the cutting plane much like a propeller thrusting air or liquid through the plane of rotation of the propeller in a direction resulting from the pitch of the blades and the bevel angle of the sharpened blade leading edge.

Food slicers of the type just described produce somewhat uniform slices during high speed, high volume slicing runs and have enjoyed commercial acceptance by food processors (e.g., canners, frozen food processors, snack food producers, etc.) and value-added processors that prepare food slices for direct consumption. However, because of the dynamics of high speed, high volume slicing of food products of variable size and hardness using tensioned and pitched rotating cutting blades on a rotating cutting wheel, control over quality of slice geometry and dimensions poses a challenge to designers of such machines.

Cutting wheels of the type used in food cutting machines described above typically contain an even multiple of blades that are driven at a rotational speed determine experimentally to produce the best cutting performance for given cutting blades and food products to be sliced. The number of blades installed on the wheel can be varied in an even multiples to maintain the wheel in balance and to vary the slice thickness of the food products moving through the cutting plane of the cutting wheel. Obviously, the fewer the number of blades installed on a given cutting wheel designed to advance unsliced portions of food products a given distance per rotation, the thicker the cut slices will be because the food product is advanced a given distance between blade engagements.

Despite rigorous efforts to design cutting machines of this kind to exacting standards, achieving uniformity of slice thickness and avoidance of slice thickness variation, usually exhibited as a slice having a thicker end or region and a thinner end or region has proven difficult to achieve, particularly in cutting machines using longer, narrower and more flexible blades as exemplified in the above-mentioned U.S. Pat. Nos. 2,482,523 and 3,004,572.

Shorter blades used in a gravity fed machine exemplified in the above-mentioned U.S. Pat. No. 2,665,723 tend to produce relatively uniform dimensioned slices because of the shorter and wider blading that can be used in such machines. The shorter blading reduces flexure of the blades during slicing of the food products so that relatively uniformly dimensioned slices can be produced using such gravity fed machines. However, not all food products can be gravity fed to the cutting blade of a gravity type food cutter on a production scale. Certain food products optimally are fed to the cutting wheel in a generally horizontal direction with the wheel oriented in a generally vertical orientation for a number of reasons known to those in the food cutting field and which are explained in U.S. Pat. No. 2,482,523. Accordingly, cutting uniform slices in high volume using vertically oriented cutting wheels of the type described above and using feed devices for advancing food products to the cutting wheel while using relatively longer blading in the cutting wheel is a recognized goal to be achieved in the field of food product slicing.

In pursuit of this goal, various approaches to solving slice size variation were attempted. These approaches included varying blade shapes and blade mounting systems (location of tension fasteners, etc.). Cutting blade flexure, particularly transverse flexure about a longitudinal axis along the blade length, was identified as a cause of slice irregularities and it was also discovered that a gate action controlling or limiting incremental advancement of the unsliced food product through the cutting plane between slices tended to produce more uniform slices. However, consistent optimum slice uniformity was still not obtained. The use of wide blades to obtain the gating effect secured some improvement and the use of a maximum practical number of wide blades on the cutting wheel enabled the production of thin slices of food products that approached uniformity, but which nonetheless were sufficiently irregular so as to be observable to a casual viewer, particularly when the slices were stacked one on top of the other.

Actually, minor slice thickness irregularity on the order of several thousandth of an inch (or the metric equivalent thereof) which is not observable to the naked eye in any individual slice becomes very observable when the slices are stacked one on top of the other. Such irregularities are not desired by food processors because irregular slices are not attractive when stacked, do not cook or fry uniformly, are not of uniform weight and thickness and tend to complicate the processing procedures, particularly when the processing involves cooking or frying very thin slices of vegetables such as potatoes to be fried for making potato chips. Obviously, sliced products that are to be purchased by consumers that may view the slices in stacked condition should be uniform in thickness for maximum visual appeal and consistent packing, as well.

In accordance with prior art attempts to obtain uniform thickness thinly sliced food products, cutter blades having relatively wider widths were used, with the blades shaped to have longer trailing edges as compared with the leading edges that included a sharpened portion. The wider width blades produced a desired gating or gauging action when sufficient blades were provided on the wheel, which usually operates at a design speed or several discrete design speeds, but blade flexing resulting from contact between the individual blades and the food products still constituted an impediment to achieving uniform slice thicknesses, particularly with harder or fibrous food product that have the ability to deflect or twist the cutting blades.

It was suspected that the speed at which the food product approaches the cutting plane of the cutting wheel could have an influence on the stability of the unsliced food product portion moving through the cutting blades, particularly when the advancement of the unsliced portion was effectively gated or periodically interrupted slightly between the conveyor feed device and the cutting wheel.

U.S. Pat. No. 2,482,523 discusses a relationship between the feeding speed of food products advanced to a vertical cutting wheel containing tensionsed pitched blades but the objective of the system described in the patent is to avoid a gating effect between blades by advancing the food product to the cutting plane of the cutting blades such that the trailing edge of each blade and all portions of the body of the blade between the cutting and trailing edges will be moved out of registry with every section of the food product being cut by the time that section moves axially through the cutting plane over a distance that would carry such section against the cutting blade body. As explained in the patent, in accordance with such design, the cutting blades offered no resistance to the path followed by the food products whereby the food products passed through the cutting plane substantially the same as if they were entire bodies instead of slices. Thus, in accordance with the patent, no part of the broad flat rear faces of the cutting blades abutted against the unsliced portion of the food product advancing through the cutting plane.

In a food cutting machine of the type described herein, wherein it is desired to gauge each slice by advancing the uncut portion of the food product forwardly just enough to precisely locate the unsliced portion in a precise position to be engaged by the next succeeding cutting blade, uniformity of sliced thicknesses prove to be less than desirable.

Accordingly, an objective of the invention is to slice uniform dimensioned slices of food products advanced through a generally vertically oriented cutting wheel of the type described above, particularly thin slices on the order of 0.125" (0.318 cm).

BRIEF SUMMARY OF THE INVENTION

One aspect of the invention is a method of cutting food products of surprisingly uniform thickness dimensions using a preferably vertically oriented rotary cutting wheel having radially extending circumferentially spaced, tensioned and pitched cutting blades rotating in a cutting plane towards which unsliced food products are advanced by a feed device. The pitched cutting blades themselves are oriented to cause a given advancement of the unsliced portion of the food products by an impeller action, and the inventive slicing method involves feeding the unsliced food products into the cutting plane of the blades at a speed corresponding closely to 101.5% of the advancing velocity of the unsliced portion of the food products caused by the blades.

The invention also comprises a cutting blade for use in a rotary cutting wheel of the type described above wherein each blade is tensioned between a pair of tension pin fasteners engaging the blades at opposed circular fastener apertures having centers of curvature located at opposite ends of the blades and lying in a common longitudinally and transversely extending tension plane and wherein the blades each includes a straight portion of the leading edge that is longer than a straight trailing edge, with the straight portion of the leading edge extending beyond the maximum distance between aperture diameters and the straight portion of the trailing edge lying within the minimum distance between aperture diameters.

The straight portion of the leading edge of each blade is sharpened over a substantial portion of its length between the apertures while the straight portion of the trailing edge extends parallel with the shortened leading edge of each blade. Each blade is shaped, tensioned and fastened, furthermore, so as to be relatively rigid along its leading and trailing edges when tensioned so as to resist flexure in bending between the fastener anchoring points both about the blade length and transversely of the blade length. For this purpose, the fastener apertures are located relative to the blade width such the tension plane lies closer to the leading edge of the blade than the trailing edge.

The combination of method steps and the combination of blade parameters constituting the present invention were found to produce uniformly dimensioned slices of food product using a rotary cutting wheel of the type described.

DESCRIPTION OF THE DRAWINGS

With reference to the appended drawings:

FIGS. 6–9 show other cutting blade configurations usable on a cutting wheel of the type illustrated in FIG. 1;

FIG. 10 is a top plan view of a preferred form of cutting blade made in accordance with the present invention; and FIGS. 11 and 12 respectively show side and end views of the blade depicted in FIG. 10.

DETAILED DESCRIPTION OF PREFERRED EMBODIMENTS OF THE INVENTION

Figure 1:
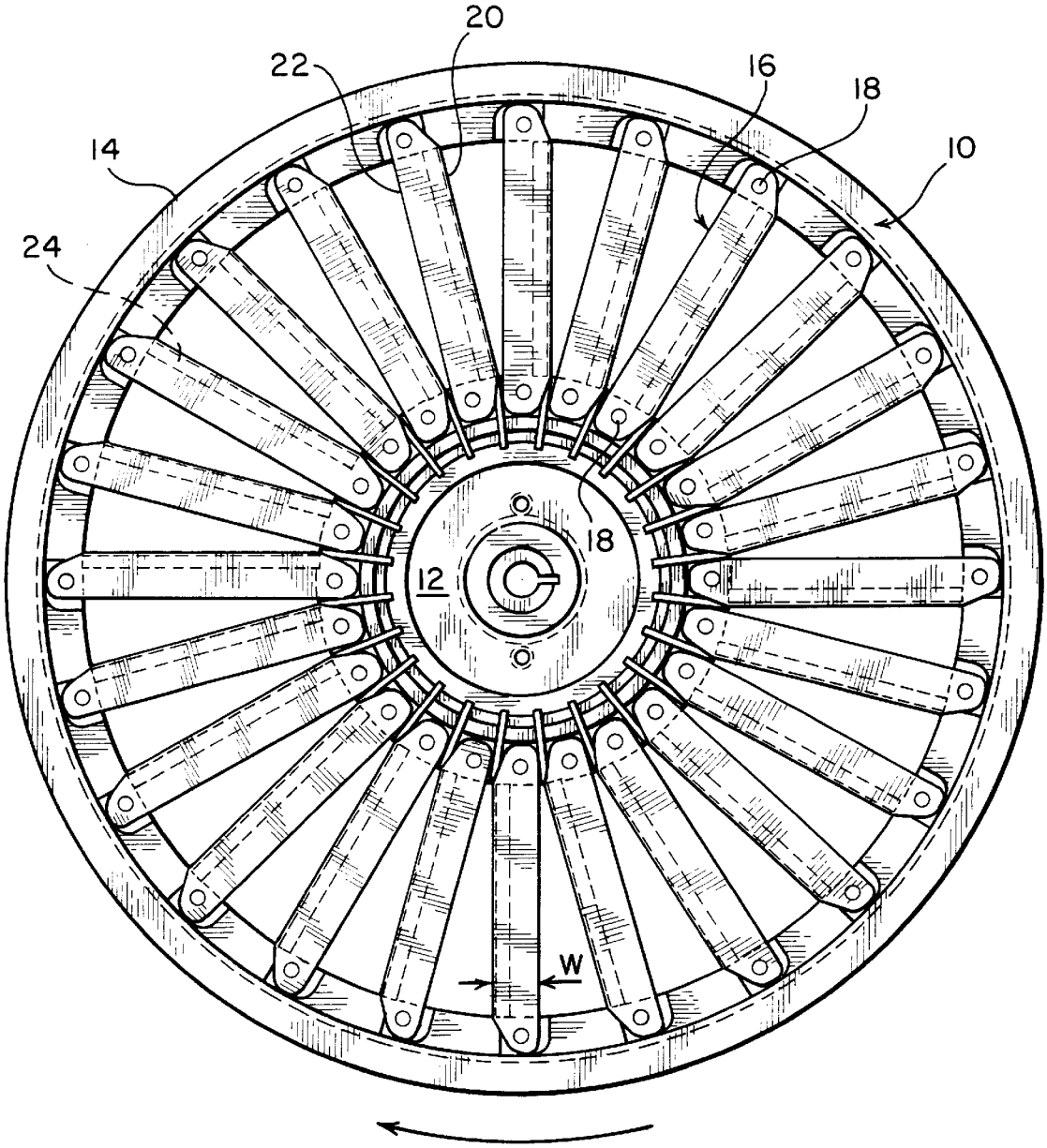
FIG. 1 shows a rear elevational view of a cutting wheel for a rotary cutting machine used to slice food products on which tensioned, circumferentially spaced, pitched, radially extending thin metal cutting blades are mounted so as to extend between tension fasteners located along a hub and rim of the cutting wheel.

With reference to the appended drawings, a cutting wheel 10 shown in FIG. 1 includes a central hub 12 and an outer rim 14. Elongated cutting blades 16 are mounted on wheel 10 so as to extend radially between the hub 12 and rim 14 in circumferentially spaced relationship. The blades 16 are secured to the hub 12 and rim 14 at their opposed ends by preferably circular tension pin fasteners 18. The blades are mounted on the wheel 10 under uniform tension, which is applied to the blades by a known tension arrangement in the hub 12, for example an arrangement such as described in U.S. Pat. No. 2,665,723. The blades 16 also are appropriately pitched or twisted along their longitudinal axes to take into account the different absolute linear speed of the blades along their lengths, for example in accordance with the principles stated in U.S. Pat. No. 2,482,523.

The pitch of the blades and the beveled cutting edge also produces an impeller or propulsive action on both the food product delivered to the cutting wheel from its rear side (the side shown in FIG. 1) as well as the slices of the product cut by the blades, all as described in the aforesaid U.S. Pat. No. 2,482,523.

For a given cutting wheel rotating at a design speed, the pitch of and number of blades 16 on the wheel 10 determines the thickness of the slices cut by the blades 16. The wheel design speed is selected to produce the best cutting action on the food product to be sliced, in accordance with well-known principles. The blades 16 themselves are relatively thin precipitation hardened 17-4 stainless steel elements 0.031 in. thick (0.079 cm) each having a leading edge 20 beveled at 24 on the front side of the blades to a cutting leading edge portion extending between the hub 12 and rim 14, and a trailing edge 22 (the wheel 10 in this example being designed to rotate clockwise as viewed from the rear to thereby define the blade leading edge as that portion first engaging a food product to be sliced by the cutting wheel).

Figure 5:
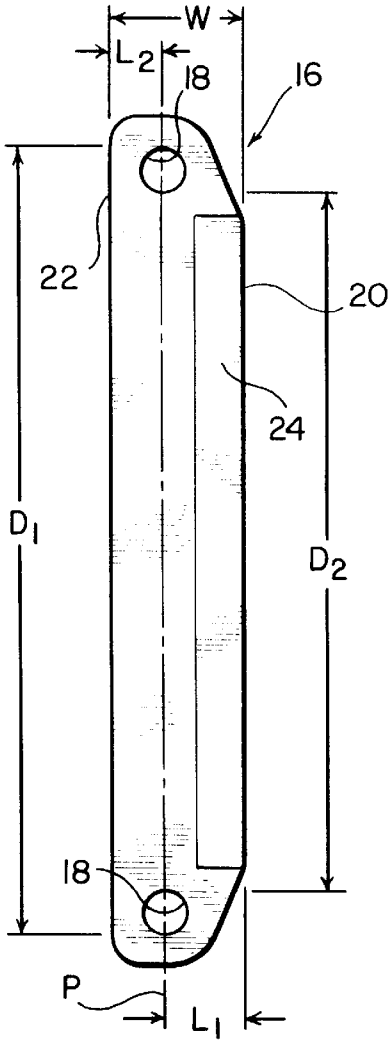
FIG. 5 shows an enlarged view of a cutting blade installed on the cutting wheel illustrated in FIG. 1.

A blade 16 is shown from its front side (opposite the side to which the product is advanced during slicing) and enlarged in FIG. 5, and has a total width denoted by W. The centers of tension fastener apertures 18 lie in a common longitudinally and transversely extending theoretical plane of tension P along which the tension forces reacted by the blade can be considered to theoretically extend. The blades 16, moreover, has a longer trailing edge straight or linear portion than the sharpened straight or linear portion of its leading edge. Although the expression "straight or linear" is used to described the leading and trailing edges, such expression is intended to mean that the edges each lie in a common single plane containing the edge, thereby including a scalloped or wavy leading edge or blade.

Thus, it will be observed that the straight portion trailing edge 22 extends beyond a length corresponding to the maximum distance $D_1$ between the diameters of apertures 18, while the straight portion of leading edge 20 is shorter than the minimum distance $D_2$ between aperture diameters. Moreover, the tension plane P lies slightly rearward of the midpoint of width W so that the distance $L_1$ from plane P to the leading edge 20 is greater than the distance $L_2$ from the plane P to the trailing edge 22.

Figure 6:
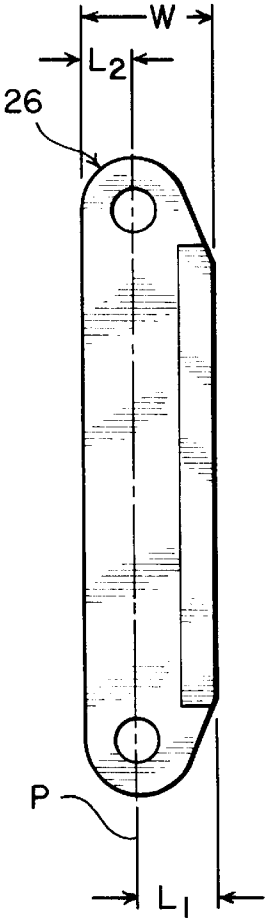
Figure 7:
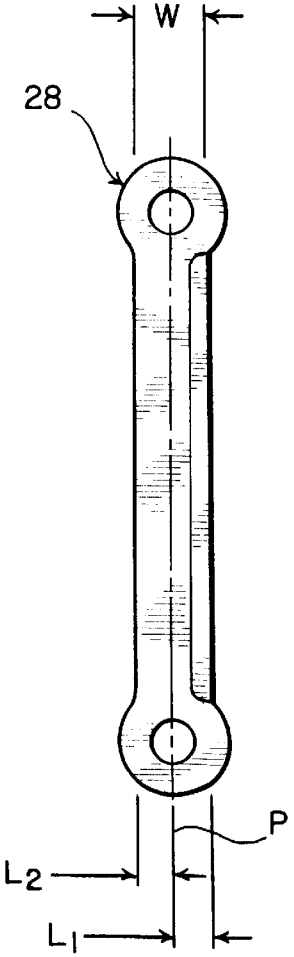

The aforesaid geometry of blades 16 was initially selected by the inventor named herein because it was believed that, as compared with other blade configurations, for example blade shapes shown in FIGS. 7, 8 and 9, the best quality slice could be produced by the cutting wheel 10. The reference point for this experimentation was the short, wide blade 26 shown in FIG. 6, which was typical of the blading used on a gravity fed, horizontally extending cutting wheel of the general type shown and described in U.S. Pat. No. 2,665,723. In blade 26, the geometry is similar to blade 16, but the blade is shorter, stiffer (due to its lesser length) and runs quite stable against flexure about its longitudinal and transverse directions. This blade configuration was recognized to produce acceptable quality food product slices of uniform thickness.

When attempts to make such a blade configuration in a longer length as shown in FIG. 5, blade flexure created slice quality variations that were less than optimum. Because the wheel 10 was designed to contain a maximum practical number of blades to provide a gating or gauging action (to be described below) during production of thin slices on the order of 0.125 in. (0.318 cm), blade flexure in either direction adversely affected sliced dimensional consistency.

The blades 28, 30 and 31 of FIGS. 7, 8 and 9, respectively, were tried in an effort to decrease or minimize blade flexure by varying the relationships between the trailing and leading edge straight portion lengths; the location of the tension plane P relative to the leading and trailing edges of the blades (i.e., varying the relationship between $L_1$, $L_2$ and W); and the width and angle of the bevelling of each blade cutting edge.

Figure 3:
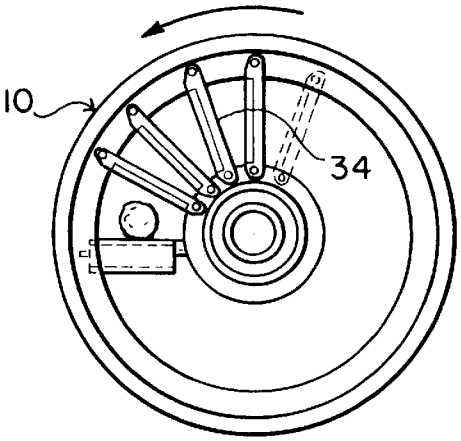
FIG. 3 shows a schematic and elevational view of one end of the system shown in FIG. 2.
Figure 2:
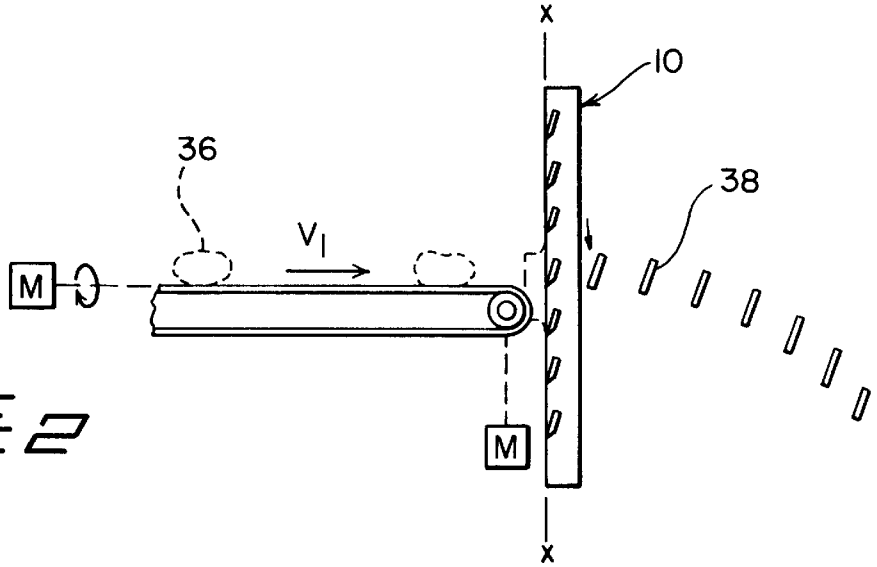
FIG. 2 is a schematic illustration showing a vertically oriented cutting wheel of the type shown in FIG. 1 in operation slicing food products advanced to the cutting wheel by a conveyor feed system.
Figure 4:
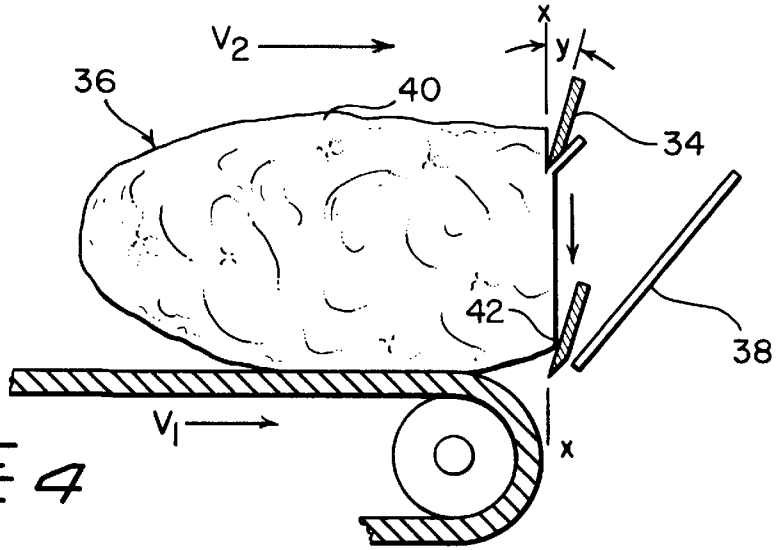
FIG. 4 shows schematically and an enlarged detail of a food product being sliced by a cutting wheel illustrated in FIG. 2.

To provide a better understanding of how these various relationships effect slice quality, reference is made to FIGS. 2, 3 and 4 which schematically illustrate the principle of operation of cutting wheel 10.

The cutting wheel 10 in accordance with FIGS. 2–4 includes an improved blade 34 constructed in accordance with FIGS. 10–12, to be described in more detail below. However, the principle of operation of the cutting wheel 10 is the same irrespective of the cutting blade used as between the cutting blades configured in accordance with blades 16 and 34.

The cutting wheel 10, as mentioned previously, operates in the same general manner as the cutting wheel system shown in U.S. Pat. Nos. 2,482,523 and 3,004,572. That is, the wheel 10 is generally vertically oriented and unsliced food products 36 shown in phantom (dashed) lines in FIG. 4 are conveyed at velocity $V_1$ towards the cutting plane X—X of blades 34, that is the plane in which the cutting edges of the blades move to perform slicing operations on the products 36.

Like the cutting wheels of the previously mentioned U.S. patents, the blades 34 are tilted and twisted to establish a blade pitch schematically illustrated at angle y in FIG. 4 at a cross-section zone of blade 34. This pitch y impels the slices 38 cut from the product 36 forwardly and also impels the unsliced portion 40 of the product 36 forwardly at velocity $V_2$, thereby preserving or adding to the momentum of the product resulting from its feed velocity $V_1$.

Unlike the ungated or ungauged cutting wheel system of U.S. Pat. No. 2,482,523, which is arranged specifically so that the blades individually cut slices without the unsliced portions of the product impacting against the rear side of the blades (see column 5, lines 60–71 of the patent), the body of the unsliced portion 40 of product 36 contacts and abuts the rear of the advancing blade 34 as shown at 42 to thereby assure a precise thickness of slice between adjacent blades 34. This process of cutting is called "gating" because an individual blade 34 not only slices the product 36, but also momentarily guides advancement of the unsliced portion 40 through the cutting plane in a very precise manner to thereby ensure that the next trailing blade contacts the unsliced product 46 at a precise location that determines slice thickness. This relationship is schematically shown in FIG. 4.

It has been observed through experimentation that best quality slices obtained for an exemplary cutting wheel 20 inches in diameter at the rim and having a hub diameter at the fastener circle able to accommodate 24 six inch blades configured to cut slices of 0.125 in. (0.318 cm) thickness while advancing the uncut food product portion 40 3.0 in. (7.62 cm) per revolution of cutting wheel using a cutting blade similar to that shown in FIG. 10 occurred when the velocity $V_1$ corresponded to about 101.5% of the velocity $V_2$. That is, velocities of $V_1$ on either side of 101.5% of $V_2$, that is, below about 101% and above about 105%, produced slices with dimensional variation including tapered slices that were of lesser quality than the slices obtained with the velocity $V_1$ approaching 101.5% of velocity $V_2$.

The blades 34 as depicted in FIG. 9 are formed of the same relatively thin, hardened stainless steel material as the blade 16 shown in FIG. 5 and described above, but the leading and trailing edges are reversed so that the leading edge 44 has a straight portion extending longer than the maximum distance $D_2$ between diameters of fastener apertures 18 and the trailing edge 46 has a straight portion as shown extending over a length that is less than the distance $D_2$ corresponding to the minimum distance between the diameters of apertures 18. Also, in accordance with the preferred blade configuration shown in FIGS. 10 to 12, the distance $L_1$ between the leading edge of each blade and the tension plane P is slightly less than the distance $L_2$ between the trailing edge 46 and the tension plane P.

For example, for a blade 43 having an exemplary width W of 0.925 in. (2.35 cm), the distance $L_1$ is on the order of 0.375 in. (0.953 cm), leaving $L_2$ as about 0.550 in. (1.399 cm). Typically, blade 34 is 6.0 in. (15.25 cm) long and the bevel 48 produces a short indentation 50 along the leading edge 44 of about 0.010 in. (0.025 cm). The wheel 10 carrying the blades 34 has an overall diameter of about 20 in. (50.8 cm) and preferably is rotated at a constant speed of 2009 rpm. which is known to provide optimum cuts for most food products, particularly fruits and vegetables. The distance between fastener apertures 18 is about 5.25 in. (13.335 cm). The pitch of the blades produces advancement of unsliced food product of 3.0 in. (7.620 cm) per revolution of the cutting wheel due to the blade pitch and the cutting edge bevel.

The bevel 48 is selected to be on the order 5°, so that a rather shallow bevel angle is obtained.

It has been observed that the blade configuration of blade 34 produced better quality slices (less dimensional variation) than the blade 16 shown in FIG. 5. It is believed that this quality improvement results from better resistance to flexure of blade 34 and better gating action on the unsliced portion 40 of the food product 36. That is, flexure depicted by arrows $F_1$ in FIG. 11 transversely of the blade length or about a transverse axis is improved or minimized by the described location of the cutting plane P along the blade and also due to the configuration and location of the straight portions of the leading and trailing edges relative to the tension fastener apertures 18. Likewise, flexure depicted by arrows $F_2$ in FIG. 12 about the blade longitudinal axis is believed to be minimized for the same reasons.

In summary, a surprising and unexpected discovery occurred when the leading and trailing edges of the blade 16 were reversed and the cutting plane P was located slightly closer to the leading edge than the trailing edge of the blade. This was unexpected, because it was previously believed that the location of the cutting plane P closer to the trailing edge of the blade would produce greater stability of the trailing edge area to improve the gating action of the blade.

The combined action of the improved cutter blades and the controlled feed speed $V_1$ in particular created uniform slices of high quality.

The principles described in connection with the blades could be applied to horizontal cutting wheels as well as to decreased flexure of longer blades.

What is claimed is:

1. A method of cutting food products into uniform thickness slices using a rotary cutting wheel fitted with radially extending, circumferentially spaced, tensioned and forwardly pitched bevel sharpened cutter blades rotating in a cutting plane and extending between a central hub and an annular rim, the blades producing a first velocity of advancement of unsliced food product across the cutting plane for each revolution of the cutting wheel and a given slice thickness during slicing of food product advanced through the cutting plane, comprising the steps of:

a) fitting an appropriate number of blades to the rotary cutting wheel to produce the given slice thickness of food products at the operational rotational velocity of the cutting wheel and rotating the cutting wheel at an operational rotational velocity to produce said first velocity of advancement of unsliced food products through the cutting plane;

b) feeding the food products to the cutting plane of the blades of the cutting wheel at a second velocity;

c) selecting a configuration and tension for the blades for effecting maximum stiffness and resistance of the blades to both longitudinal and transverse flexure during cutting of food products; and d) advancing the unsliced food products to the cutter blades with said second velocity corresponding closely to about 101.5% of the first velocity.

2. The method of claim 1, wherein the cutter blade comprises a generally thin, flat elongated blade member having opposed leading and trailing edge portions and opposed end areas; said straight leading edge portion extending over the full length of the blade up to the end areas and said trailing edge portion comprising a central straight portion extending parallel to said leading edge portion and trailing edge ends at opposite ends of said straight trailing edge portion extending inwardly towards and intersecting said end areas at opposite ends of said straight trailing edge portion; a singular circular fastener aperture at each end area of each blade member for receiving tension applying and blade retaining fasteners, the centers of said apertures aligned in a common plane of tension extending longitudinally along and transversely of the blade member and spaced apart a distance defining maximum and minimum distances between aperture diameters; and further wherein the straight leading and trailing edge portions of each blade member are of unequal lengths and extend parallel with said common plane of tension; a sharpened cutting edge formed on a portion of the straight leading edge portion of the blade member, the improvement comprising:

the straight leading edge portion of the blade member is longer than the maximum distance between the aperture diameters and the straight trailing edge portion of the blade member is shorter than the minimum distance between aperture diameters.

3. The method of claim 1, wherein the cutter blade comprises a generally thin, flat elongated blade member having opposed leading and trailing edge portions and opposed end areas; said straight leading edge portion extending over the full length of the blade up to the end areas and said trailing edge portion comprising a central straight portion extending parallel to said leading edge portion and trailing edge ends at opposite ends of said straight trailing edge portion extending inwardly towards and intersecting said end areas at opposite ends of said straight trailing edge portion; a singular circular fastener aperture at each end area of each blade member for receiving tension applying and blade retaining fasteners, the centers of said apertures aligned in a common plane of tension extending longitudinally along and transversely of the blade member and spaced apart a distance defining maximum and minimum distances between aperture diameters; and further wherein the straight leading and trailing edge portions of each blade member are of unequal lengths and extend parallel with said common plane of tension; a sharpened cutting edge formed on a portion of the straight leading edge portion of the blade member, the improvement comprising:

the straight leading edge portion of the blade member is longer than the maximum distance between the aperture diameters and the straight trailing edge portion of the blade member is shorter than the minimum distance between aperture diameters; and wherein the plane of tension lies closer to the straight portion of the leading edge than the straight portion of the trailing edge.

4. The method of claim 1, wherein each blade comprises a generally thin, flat elongated blade member having opposed leading and trailing edge portions and opposed end areas; said straight leading edge portion extending over the full length of the blade up to the end areas and said trailing edge portion comprising a central straight portion extending parallel to said leading edge portion and trailing edge ends at opposite ends of said straight trailing edge portion extending inwardly towards and intersecting said end areas at opposite ends of said straight trailing edge portion; a singular circular fastener aperture at each end area of each blade member for receiving tension applying and blade retaining fasteners, the centers of said apertures aligned in a common plane of tension extending longitudinally along and transversely of the blade member and spaced apart a distance defining maximum and minimum distances between aperture diameters; and further wherein the straight leading and trailing edge portions of each blade member are of unequal lengths and extend parallel with said common plane of tension; a sharpened cutting edge formed on a portion of the straight leading edge portion of the blade member;

the straight leading edge portion of the blade member is longer than the maximum distance between the aperture diameters and the straight trailing edge portion of the blade member is shorter than the minimum distance between aperture diameters;

the plane of tension lies closer to the straight portion of the leading edge than the straight portion of the trailing edge; and wherein the straight portion of the blade member leading edge is beveled to produce a sharpened leading cutting edge, said bevel extending at an acute angle on the order of 5° relative to a plane including the cutter blade.

5. A cutter blade for a rotary cutting wheel useful for slicing food products wherein each blade comprises a generally thin, flat elongated blade member having opposed leading and trailing edge portions and opposed end areas; said straight leading edge portion extending over the full length of the blade up to the end areas and said trailing edge portion comprising a central straight portion extending parallel to said leading edge portion, and trailing edge ends at opposite ends of said straight trailing edge portion extending inwardly towards and intersecting said end areas at opposite ends of said straight trailing edge portion; a singular circular fastener aperture at each end area of each blade member for receiving tension applying and blade retaining fasteners, the centers of said apertures aligned in a common plane of tension extending longitudinally along and transversely of the blade member and spaced apart a distance defining maximum and minimum distances between aperture diameters; and further wherein the straight leading and trailing edge portions of each blade member are of unequal lengths and extend parallel with said common plane of tension; a sharpened cutting edge formed on a portion of the straight leading edge portion of the blade member; said straight leading edge portion of the blade member being longer than the maximum distance between the aperture diameters and the straight trailing edge portion of the blade member being shorter than the minimum distance between aperture diameters.

6. The cutter blade as claimed in claim 5, wherein the plane of tension lies closer to the straight portion of the leading edge than the straight portion of the trailing edge.

7. The cutter blade as claimed in claim 6, wherein the straight portion of the blade member leading edge is beveled to produce a sharpened leading cutting edge, said bevel extending at an acute angle on the order of 5° relative to a plane including the cutter blade.

* * * * *